US007908783B2

(12) United States Patent
Howe et al.

(10) Patent No.: US 7,908,783 B2
(45) Date of Patent: Mar. 22, 2011

(54) TWO IN ONE SIGHT

(76) Inventors: Phillip D. Howe, Fort Collins, CO (US); Richard A. Moore, Fort Collins, CO (US)

( * ) Notice: Subject to any disclaimer, the term of this patent is extended or adjusted under 35 U.S.C. 154(b) by 373 days.

(21) Appl. No.: 12/243,331

(22) Filed: Oct. 1, 2008

(65) Prior Publication Data

US 2009/0126251 A1 May 21, 2009

Related U.S. Application Data

(60) Provisional application No. 60/988,482, filed on Nov. 16, 2007.

(51) Int. Cl.
*F41G 1/32* (2006.01)

(52) U.S. Cl. ..... 42/145; 42/144; 42/132

(58) Field of Classification Search ..... 42/111, 42/113, 122, 123, 130, 131, 132, 144, 145, 42/124, 127; 33/265; 362/110, 111, 112, 362/577, 581, 249.1, 288, 398
See application file for complete search history.

(56) References Cited

U.S. PATENT DOCUMENTS

| | | | | | |
|---|---|---|---|---|---|
| 2,727,309 | A * | 12/1955 | Jenkins | 42/144 |
| 3,284,905 | A * | 11/1966 | Simmons | 42/144 |
| 5,373,657 | A * | 12/1994 | Betz et al. | 42/111 |
| 5,384,980 | A * | 1/1995 | Johnson et al. | 42/144 |
| 5,836,100 | A * | 11/1998 | Stover | 42/132 |
| 5,956,854 | A * | 9/1999 | Lorocco | 42/132 |
| 6,122,833 | A * | 9/2000 | Lorocco | 42/132 |
| 6,421,946 | B1 * | 7/2002 | LoRocco | 42/111 |
| 6,446,377 | B1 * | 9/2002 | Hollenbach et al. | 42/148 |
| 6,604,315 | B1 * | 8/2003 | Smith et al. | 42/112 |
| 2002/0073597 | A1 * | 6/2002 | LoRocco | 42/111 |

* cited by examiner

*Primary Examiner* — Michael Carone
*Assistant Examiner* — Jonathan C Weber
(74) *Attorney, Agent, or Firm* — Ancel W. Lewis, Jr.

(57) ABSTRACT

An aiming sight has a base, two oppositely facing light emitting elements on the base, a pivot upon which the base rotates, a detent that holds the base at selected positions, and a spring, magnet or other structure that presses the sight towards the aimed device upon which the sight is mounted. The sight is selectively rotated so that one of the light emitting elements faces the user for aiming, without removing the sight or the light emitting elements from the aimed device.

16 Claims, 4 Drawing Sheets

TWO IN ONE SIGHT

This application claims the benefit under 35 U.S.C. §119 (e) of the U.S. provisional patent application No. 60/988,482 filed Nov. 16, 2007.

TECHNICAL FIELD

The present invention relates to aiming sights and more particularly to an aiming sight selectable between two light emitting elements.

BACKGROUND ART

Modern firearms are inherently very accurate. The ability to shoot accurately depends on accurate pointing or aiming, and often requires rapid acquisition of the target. Known sights commonly have a front sight in the form of a small bead sight near the muzzle or front of the firearm barrel. Such sights can also have a rear sight near the breach or rear of the firearm barrel.

Conventional bead sights have several shortcomings. Bead sights are difficult to see in low light conditions and against dark backgrounds. One improvement to front sights relative to the bead sight is the use of a small artificial light source to replace the bead sight. The light source can be electrical or photo chemical. Front sights with artificial light sources are relatively complex and require periodic replacement of the light or power source.

Another improvement is the use of a light-gathering tube or rod, generally of a colored plastic material, to replace the bead sight. Such light-gathering rods have a length many times the cross sectional dimension, and thereby have a peripheral surface area much greater than the end area. Light is absorbed through the peripheral surface and emitted through the end of the tube. A front sight with a light-gathering tube is easily seen in low light conditions and against a dark background.

Different light-gathering tubes, such as different color light-gathering tubes, are more easily seen in different lighting conditions and against different terrain backgrounds. Changing a sight with one light-gathering tube for another sight with a different light-gathering tube, in the field, in cold weather or in low light conditions is difficult. Changing a sight with one light-gathering tube for another sight with a different light-gathering tube, in the field, in cold weather or in low light conditions can also expose body parts to the firearm muzzle, and is therefore unsafe. Some prior known sights allow the light-gathering tube to be changed without removing the sight from the firearm. Changing a light-gathering tube for a different light-gathering tube, in the field, in cold weather or in low light conditions is still difficult and unsafe.

DISCLOSURE OF THE INVENTION

An aiming sight includes a base, means for mounting the base on an aimed device, a first light emitting element and a second light emitting element. The base has a first end with a first end wall and a spaced second end with a second end wall. The first light emitting element extends through the first end wall and the second light emitting element extends through the second end wall, so that the first light emitting element is visible when the first end is facing a user and the second light emitting element is visible when the second end is facing a user. The means for mounting includes a pivot and a means for biasing the base towards the aimed device. The base rotatably and slidably mounts on the pivot, and includes a detent for holding the base relative to the aimed device with either the first or second end wall facing the user. A transparent cover over the base between the first and second end walls seals the aiming sight.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
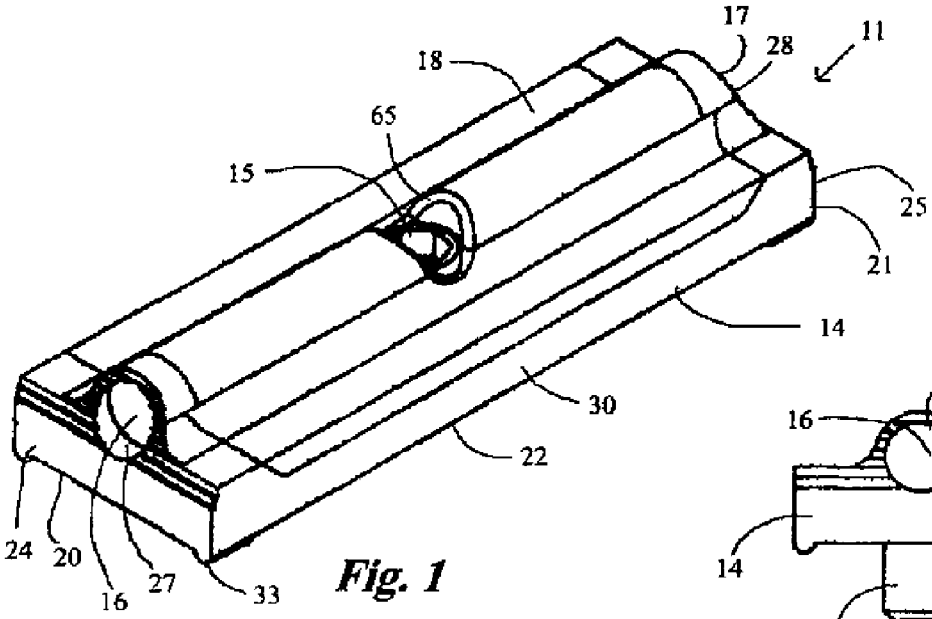
FIG. 1 is a perspective view of an aiming sight embodying features of the present invention.
Figure 4:
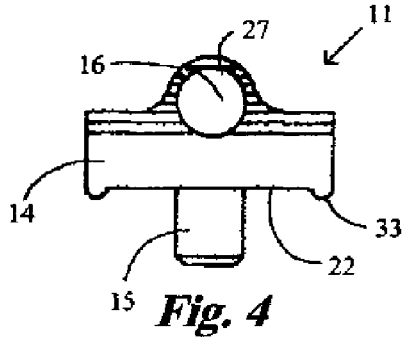
FIG. 4 is a end elevation view of the aiming sight of FIG. 1.
Figure 2:
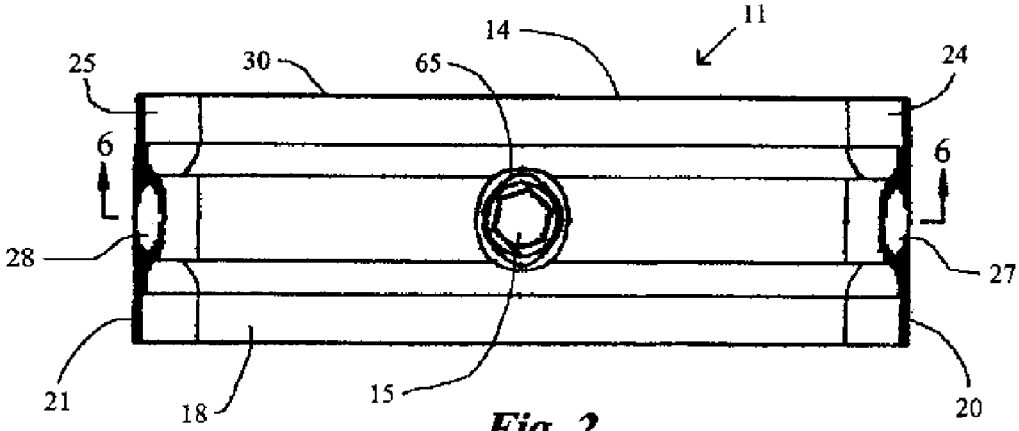
FIG. 2 is a top plan view of the aiming sight of FIG. 1.
Figure 3:
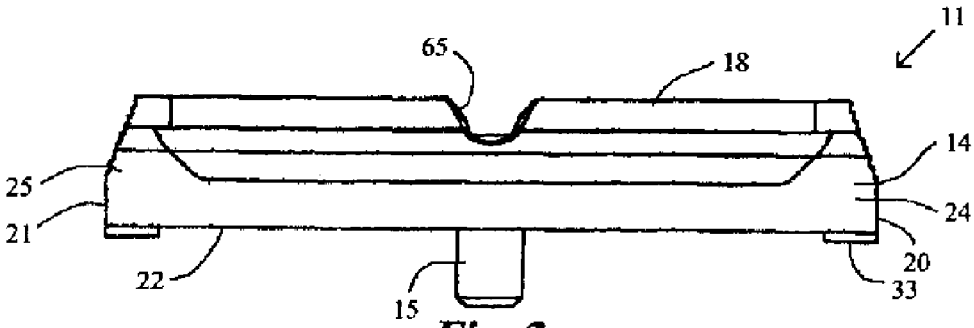
FIG. 3 is a side elevation view of the aiming sight of FIG. 1.

Referring to FIGS. 1 to 5, an aiming sight 11 embodying features of the present invention includes a base 14, a means for mounting 15 the base 14 onto an aimed device, a first light emitting element 16, a second light emitting element 17 and a cover 18. The base 14 is preferably made of an opaque plastic, and has a first end 20, a spaced second end 21 and an elongated, rectangular bottom portion 22 extending between the first and second ends 20 and 21.

Describing the specific embodiments herein chosen for illustrating the invention, certain terminology is used which will be recognized as being employed for convenience and having no limiting significance. For example, the terms "front", "back", "right", "left" "vertical", "horizontal", "lateral", "longitudinal", "upper" and "lower" refer to the illustrated embodiment in its normal position of use. Further, all of the terminology above-defined includes derivatives of the word specifically mentioned and words of similar import.

A first end wall 24 projects upwardly from the bottom portion 22 at the first end 20 and a spaced second end wall 25 projects upwardly from the bottom portion 22 at the second end 21. A first element aperture 27 extends through the first end wall 24 in a fore/aft direction. A second element aperture 28 extends through the second end wall 25 in a fore/aft direction. A pair of spaced side walls 30 project upwardly from opposite side edges of the bottom portion 22, each extending from the first end wall 24 to the second end wall 25. A mounting aperture 31 extends through the bottom portion 22 between the first and second end walls 24 and 25 and between the side wall 30. A detent 33, in the form of a small fore/aft ridge, protrudes downwardly from each corner of the bottom portion 22.

The means for mounting 15 includes a pivot 35 and a means for biasing 36 the base 14 towards an aimed device. The pivot 35 extends through the mounting aperture 31 in the bottom portion 22 in the base 14. The base 14 is rotatable around the pivot 35 and slidable along the pivot 35. The detents 33, in combination with means for biasing 36, hold or secure the base 14 at a selected orientation relative to an aimed device.

The means for mounting 15 shown includes a pivot 35 in the form of a shoulder bolt 38 and a means for biasing 36 in the form of a spring member 39. The shoulder bolt 38 has a smooth, cylindrical shoulder portion 41, a radially outwardly projecting head 42 at one end of the shoulder portion 41 and a threaded portion 43 projecting longitudinally from the other end of the shoulder portion 41. The head 42 shown has a tool cavity 44 shaped to receive a hex bit or Allen wrench. Other shapes of tool cavity 44 can be used, such as for a straight blade screwdriver, Phillips screwdriver or Torx bit. The spring member 39 includes a ring-shaped center portion 45 and a pair of resilient arms 46. The center portion 45 fits on the shoulder portion 41 of the shoulder bolt 38. The arms 46 extend radially outwardly from the center portion 45, and curve downwardly to contact the bottom portion 22. Other spring type means for biasing 36 could be used.

Figure 5:
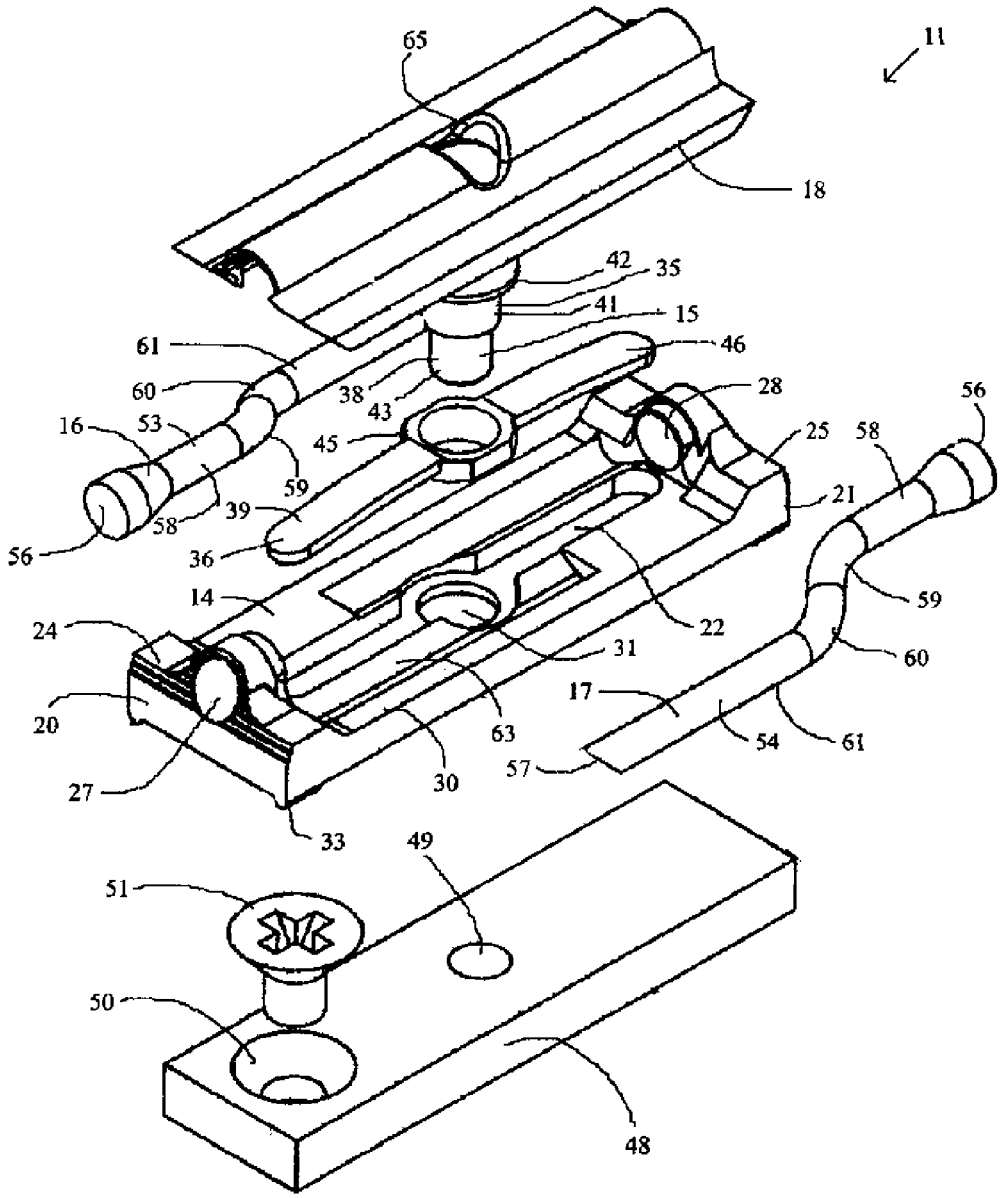
FIG. 5 is an exploded view of the aiming sight of FIG. 1 with a mounting adapter.

The threaded portion 43 of the shoulder bolt 38 can be threaded directly into a threaded aperture in an aimed device, or, as shown in FIG. 5, the means for mounting 15 can include an adapter 48. The adapter 48 has an elongated, thin block shape. The adapter 48 has a vertical center aperture 49 sized to receive the threaded portion 43 of the shoulder bolt 38, a mounting aperture 50 that extends through the adapter 48 between the center aperture 49 and one end of the adapter 48, and a mounting screw 51 that extends through the mounting aperture 50 to secure the adapter 48 to an aimed device. The adapter 48 facilitates mounting the sight 11 on a great variety of firearms or other aimed devices using existing factory sight holes and moves the sight 11 rearwardly relative to the muzzle of a firearm.

The first light emitting element 16 shown is a first light-gathering rod 53 of a first color and the second light emitting element 17 shown is a second light-gathering rod 54 of a second color. By way of example, and not as a limitation, the first and second light emitting elements 16 and 17 can each be a light-gathering rod used in concert with a fluorescent painted fixture, a phosphorescent fixture or a radiating (e.g. tritium) fixture or each can be a fluorescent painted fixture, a phosphorescent fixture or a radiating (e.g. tritium) fixture. By way of example, and not as a limitation, the first and second colors can be red and green, red and yellow, or yellow and blue.

The first and second light-gathering rods 53 and 54 each has a first end face 56, a spaced second end face 57. The first and second light-gathering rods 53 and 54 are each generally S-shaped with a first straight section 58 extending from the first end face 56, a first curved section 59 extending from the first straight section 58, an oppositely curving second curved section 60 extending from the first curved section 59, and a second straight section 61 extending from the second curved section 60 to the second end face 57. The second end face 57 slants at about 45 degrees.

Each of the side wall 30 of the base 14 has an upwardly opening channel 63 that extends longitudinally along a portion of the side wall 30 to one of the first or second end walls 24 or 25, and is sized to receive a portion of one of the first or second light-gathering rods 53 or 54. The first light-gathering rod 53 extends through the first end wall 24 with first end face 56 facing longitudinally outwardly. The first straight section 58 of the first light-gathering rod 53 extends longitudinally inwardly towards the shoulder bolt 38. The first curved section 59 of the first light-gathering rod 53 curves laterally outwardly and slightly downwardly between the first end wall 24 and the shoulder bolt 38. The second curved section 60 of the first light-gathering rod 53 curves towards the second end wall 25 and slightly downwardly. The second straight section 61 of the first light-gathering rod 53 fits into one of the channels 63 and extends towards the second end wall 25.

The second light-gathering rod 54 extends through the second end wall 25 with first end face 56 facing longitudinally outwardly. The first straight section 58 of the second light-gathering rod 54 extends longitudinally inwardly towards the shoulder bolt 38. The first curved section 59 of the second light-gathering rod 54 curves laterally outwardly and slightly downwardly between the second end wall 25 and the shoulder bolt 38. The second curved section 60 of the second light-gathering rod 54 curves towards the first end wall 24 and slightly downwardly. The second straight section 61 of the second light-gathering rod 54 fits into the other channel 63 and extends towards the first end wall 24. The first light-gathering rod 53 curves around one side of the pivot 35 and the second light-gathering rod 54 curves around the opposite side of the pivot 35.

The cover 18 is transparent, preferably made of plastic, and is sized and shaped to fit on the base 14 over the first and second light-gathering rods 53 and 54, the spring member 39, and the shoulder bolt 38. The cover 18 extends from the first end wall 24 to the second end wall 25 and from one side wall 30 to the other side wall 30. A tool aperture 65, that is smaller than the head 42 of the shoulder bolt 38, extends through the cover 18 in alignment with the center of head 42 of the shoulder bolt 38. After the first and second light-gathering rods 53 and 54, the spring member 39, and the shoulder bolt 38 are assembled to the base 14, the cover 18 is attached to the base 14 and sealed around the perimeter. The cover 18 captures the first and second light-gathering rods 53 and 54, and the shoulder bolt 38. The cover 18 prevents dust, dirt and moisture infiltration and consequent deposition upon the first and second light-gathering rods 53 and 54. The tool aperture 65 allows the shoulder bolt 38 to be tightened into the adapter 48 or an aimed device.

Figure 6:
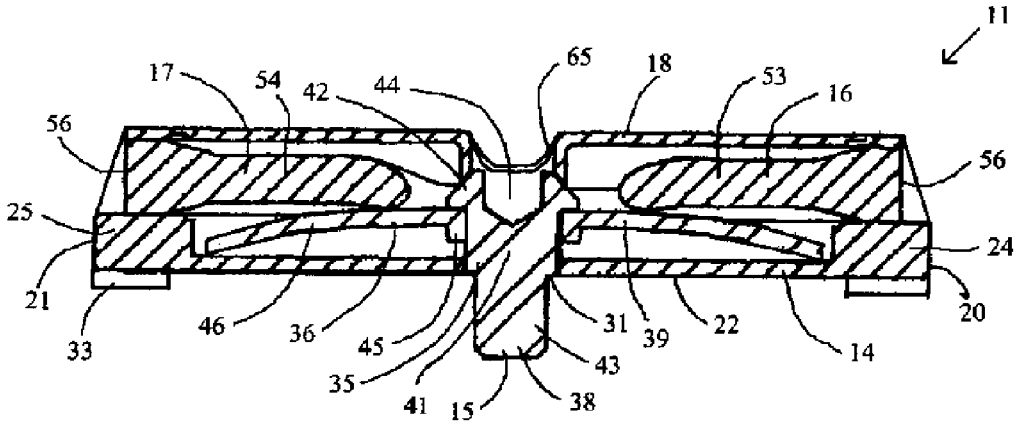
FIG. 6 is a sectional view of the aiming sight of FIG. 1 taken along line 6-6 of FIG. 2.

As shown in FIG. 6, the combined thickness of the bottom portion 22 of the base 14 and the center portion 45 of the spring member 39 is less than the length of the shoulder portion 41 of the shoulder bolt 38. When the shoulder bolt 38 is tightened into the adapter 48 or an aimed device, the arms 46 of the spring member 39 bias the base 14 against the adapter 48 or aimed device, and the detents 33 on the base 14 straddle the adapter 48 or aimed device, preventing rotation of the aiming sight 11. To rotate the aiming sight 11, the base 14 is pulled away from the adapter 48 or aimed device until the detents 33 clear the adapter 48 or aimed device. The first or second light emitting element 16 or 17 can easily be selected for aiming without removing the aiming sight 11 from the aimed device, in the field, in cold weather and in low light conditions.

FIGS. 8 to 11 show the aiming sight 11 embodying features of the present invention with a modified base 67 and a means for mounting 15 having an alternative means for biasing 68. The base 67 has a first end 70, a spaced second end 71 and an elongated, rectangular bottom portion 72 extending between the first and second ends 70 and 71. A first end wall 74 projects upwardly from the bottom portion 72 at the first end 70 and a spaced second end wall 75 projects upwardly from the bottom portion 72 at the second end 71. A first element aperture 77 extends through the first end wall 74 in a fore/aft direction. A second element aperture 78 extends through the second end wall 75 in a fore/aft direction.

A pair of spaced side walls 80 project upwardly from opposite side edges of the bottom portion 72, each extending from the first end wall 74 to the second end wall 75. A mounting aperture 81 extends through the bottom portion 72 between the first and second end walls 74 and 75 and between the side walls 80. A detent 83, in the form of a small fore/aft ridge, protrudes downwardly along each lateral edge of the bottom portion 72.

A pair of upwardly opening, spaced magnet cavities 86 are relieved into the bottom portion 72 between the side walls 80, with one magnet cavity 86 being between the first end wall 74 and the mounting aperture 81 and the other magnet cavity 86 being between the second end wall 75 and the mounting aperture 81. A pair of upwardly opening channel 87 are relieved into the bottom portion 72. One channel 87 extends from about the mounting aperture 81 to the first end wall 74, between one of the magnet cavities 86 and one of the side walls 80. The other channel 87 extends from about the mounting aperture 81 to the second end wall 74, between the other magnet cavity 86 and the other side wall 80. The channels 87 are sized and shaped to receive a portion of one of the first or second light-gathering rods 53 or 54.

The means for biasing 68 includes two magnets 89 and a magnet connector 90. The magnets 89 are each sized to fit into one of the magnet cavities 86 in the bottom portion 72 of the base 67. The magnet retainer 90 is made of a magnetic material such as steel, and has a center portion 92 and a pair of oppositely extending wings 93. The center portion 92 is generally round and has a center aperture 94 sized to receive the shoulder portion 41 of the shoulder bolt 38. The wings 93 each extend upwardly from the center portion 92 and then extend radially outwardly to a flat section 95 that is sized to fit over one of the magnets 89. The magnet retainer 90 magnetically connects the magnets 89 and increases the biasing force of the means for biasing 68.

Figure 8:
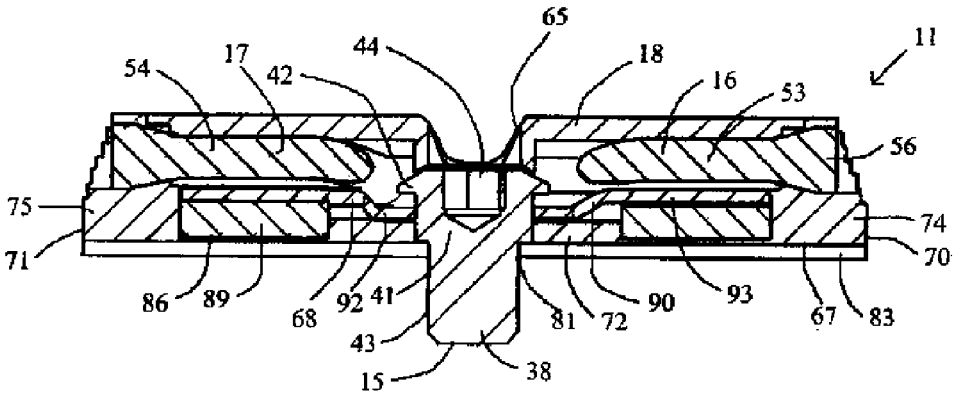
FIG. 8 is a sectional view of the aiming sight of FIG. 1, with the alternative means for biasing of FIG. 7, taken along line 6-6 of FIG. 2.
Figure 7:
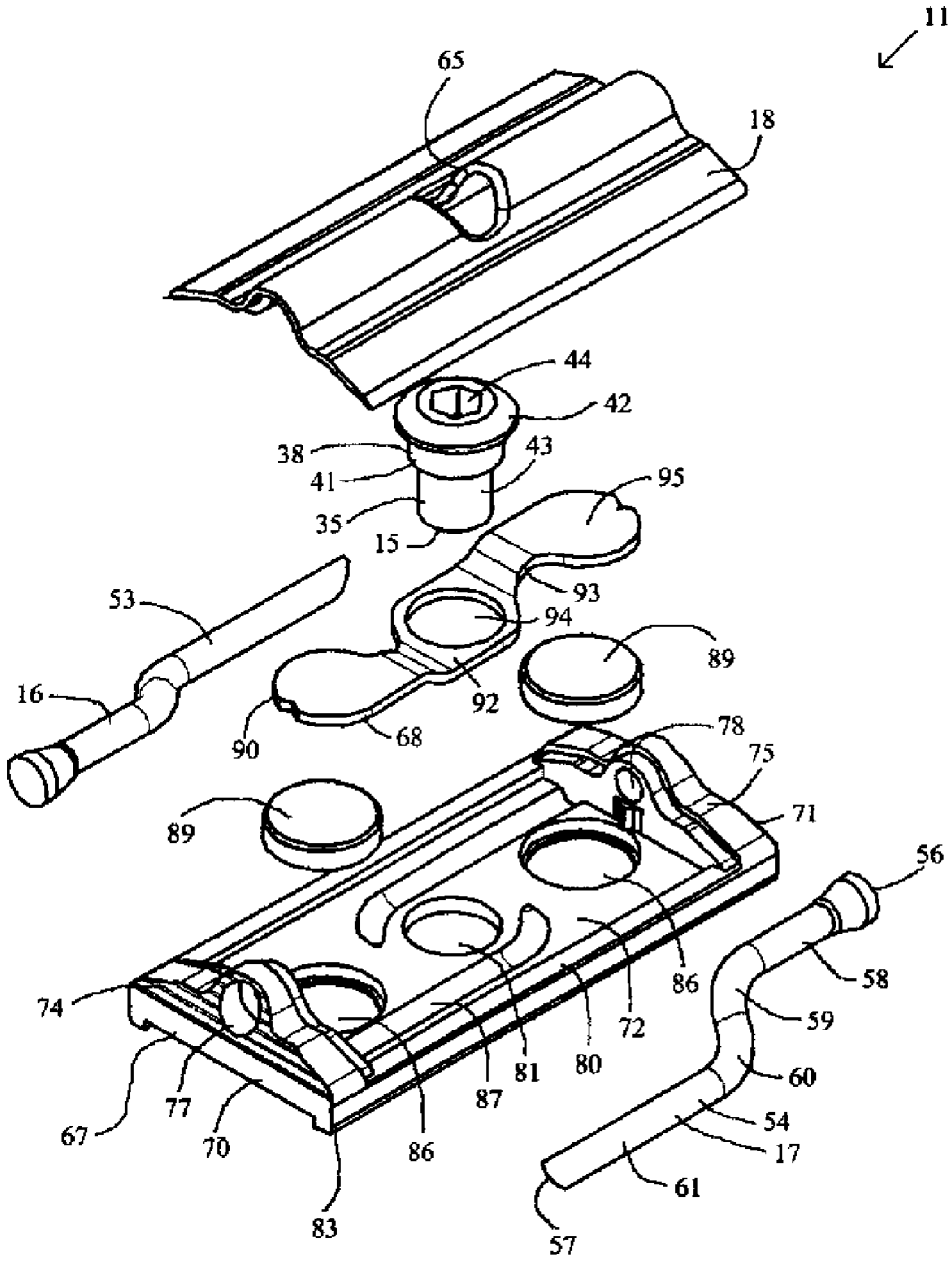
FIG. 7 is an exploded view of the aiming sight of FIG. 1, with an alternative means for biasing the base.

As shown in FIG. 8, the combined thickness of the bottom portion 72 of the base 67 and the center portion 92 of the magnet retainer 90 is less than the length of the shoulder portion 41 of the shoulder bolt 38. When the shoulder bolt 38 is tightened into the adapter 48 or an aimed device, the magnets 89 bias the base 67 against the adapter 48 or aimed device, and the detents 83 on the base 67 straddle the adapter 48 or aimed device, preventing rotation of the aiming sight 11. To rotate the aiming sight 11, the base 67 is pulled away from the adapter 48 or aimed device until the detents 83 clear the adapter 48 or aimed device. The first or second light emitting element 16 or 17 can easily be selected for aiming without removing the aiming sight 11 from the aimed device, in the field, in cold weather and in low light conditions.

Although the present invention has been described with a certain degree of particularity, it is understood that the present disclosure has been made by way of example and that changes in details of structure may be made without departing from the spirit thereof.

What is claimed is:

1. An aiming sight for an aimed device, comprising:

a base having a first end and a spaced second end, a first light emitting element having a first color, mounted on said base, visible from said first end and invisible from said second end, a second light emitting element having a second color, mounted on said base, visible from said second end and invisible from said first end, wherein said first color is different from said second color, and means for mounting said base on said aimed device, whereby when said base is mounted on said aimed device with said first end facing a user, said first light emitting element is used to aim said aimed device, and when said base is mounted on said aimed device with said second end facing said user, said second light emitting element is used to aim said aimed device.

2. The sight as set forth in claim 1 wherein said means for mounting includes a pivot with said base being rotatable on said pivot, whereby said base is rotated between said first end facing said user and said second end facing said user without removing said base from said aimed device.

3. The sight as set forth in claim 2 wherein said base includes a detent for positioning and holding said base on said aimed device with said first end facing said user and for positioning and holding said base on said aimed device with said second end facing said user.

4. The sight as set forth in claim 3:

wherein said base is slidable on said pivot towards and away from said aimed device, and including means for biasing said base towards said aimed device, whereby said base is pulled away from said aimed device to release said detent.

5. The sight as set forth in claim 4 wherein said means for mounting includes a shoulder bolt with a shoulder portion between a head and a threaded portion, and said base includes a mounting aperture between said first end and said second end, said mounting aperture being sized to receive said shoulder portion, whereby said base is rotatable around said shoulder portion and slidable along said shoulder portion.

6. The sight as set forth in claim 5 wherein said means for biasing includes a spring member that biases said base towards said aimed device.

7. The sight as set forth in claim 6 wherein said spring member has a center portion that mounts on said shoulder portion of said shoulder bolt and a pair of oppositely extending, resilient arms that press against said base to bias said base toward said aimed device.

8. The sight as set forth in claim 5 wherein said means for biasing includes at least one magnet mounted in said base.

9. The sight as set forth in claim 5 wherein said means for biasing includes two spaced magnets mounted on said base and a magnet retainer having a center portion with a center aperture sized to receive said shoulder portion of said shoulder bolt and a pair of wings that extend from said center portion radially outwardly over said magnets and retain said magnets.

10. The sight as set forth in claim 9 wherein said magnet retainer is made of a magnetic material, magnetically connects said magnets and increases the biasing force of said means for biasing.

11. The sight as set forth in claim 2 wherein said first light emitting element is a first light-gathering rod with a first color and said second light emitting element is a second light-gathering rod with a second color.

12. The sight as set forth in claim 11 wherein said first light-gathering rod curves around one side of said pivot and said second light-gathering rod curves around an opposite side of said pivot.

13. The sight as set forth in claim 11 wherein:

said first light-gathering rod has a first end face at said first end of said base, a spaced second end face, a first straight section extending from said first end face, a first curved section extending from said first straight section, an oppositely curving second curved section extending from said first curved section, and a second straight section extending from said second curved section to said second end face, and said second light-gathering rod has a first end face at said second end of said base, a spaced second end face, a first straight section extending from said first end face, a first curved section extending from said first straight section, an oppositely curving second curved section extending from said first curved section, and a second straight section extending from said second curved section to said second end face, whereby said first light-gathering rod extends beyond said pivot towards said second end of said base, and said second light-gathering rod extends beyond said pivot towards said first end of said base.

14. The sight as set forth in claim 11 including a transparent cover on said base over said first and second light-gathering rods.

15. An aiming sight for an aimed device, comprising:

a base having a first end, a spaced second end, a bottom portion between said first end and said second end, a mounting aperture through said bottom portion between said first end and said second end, and a detent for positioning and holding said base on said aimed device with said first end facing said user and for positioning and holding said base on said aimed device with said second end facing said user, a first light-gathering rod with a first color, mounted on said base, visible from said first end and invisible from said second end, a second light-gathering rod with a second color, mounted on said base, visible from said second end and invisible from said first end, wherein said first color is different from said second color, a shoulder bolt for mounting said base on said aimed device, said shoulder bolt having a shoulder portion between a head and a threaded portion, said shoulder portion being sized to extend through said mounting aperture on said base, a spring member having a center portion that mounts on said shoulder portion of said shoulder bolt and a pair of oppositely extending, resilient arms that press against said base to bias said base toward said aimed device, and a transparent cover on said base over said first and second light-gathering rods, whereby when said base is mounted on said aimed device with said first end facing a user, said first light-gathering rod is used to aim said aimed device, and when said base is mounted on said aimed device with said second end facing said user, said second light-gathering rod is used to aim said aimed device.

16. An aiming sight for an aimed device, comprising:

a base having a first end, a spaced second end, a bottom portion between said first end and said second end, a mounting aperture through said bottom portion between said first end and said second end, and a detent for positioning and holding said base on said aimed device with said first end facing said user and for positioning and holding said base on said aimed device with said second end facing said user, a first light-gathering rod with a first color, mounted on said base, visible from said first end and invisible from said second end, a second light-gathering rod with a second color, mounted on said base, visible from said second end and invisible from said first end, wherein said first color is different from said second color, a shoulder bolt for mounting said base on said aimed device, said shoulder bolt having a shoulder portion between a head and a threaded portion, said shoulder portion being sized to extend through said mounting aperture on said base, two spaced magnets mounted on said base, a magnet retainer made of a magnetic material, said magnet retainer having a center portion with a center aperture sized to receive said shoulder portion of said shoulder bolt and a pair of wings that extend from said center portion radially outwardly over said magnets and retain said magnets, and a transparent cover on said base over said first and second light-gathering rods, whereby when said base is mounted on said aimed device with said first end facing a user, said first light-gathering rod is used to aim said aimed device, and when said base is mounted on said aimed device with said second end facing said user, said second light-gathering rod is used to aim said aimed device.

* * * * *